US009752264B2

(12) United States Patent
Silagy

(10) Patent No.: US 9,752,264 B2
(45) Date of Patent: Sep. 5, 2017

(54) MANUALLY-OPERATED CLOTHES WASHING APPARATUS

(71) Applicant: Howard Silagy, Pawcatuck, CT (US)

(72) Inventor: Howard Silagy, Pawcatuck, CT (US)

( * ) Notice: Subject to any disclaimer, the term of this patent is extended or adjusted under 35 U.S.C. 154(b) by 56 days.

(21) Appl. No.: 14/714,398

(22) Filed: May 18, 2015

(65) Prior Publication Data

US 2015/0337473 A1 Nov. 26, 2015

Related U.S. Application Data

(60) Provisional application No. 62/000,734, filed on May 20, 2014.

(51) Int. Cl.

| | |
|---|---|
| ***D06F 5/04*** | (2006.01) |
| ***D06F 57/00*** | (2006.01) |
| *D06F 1/12* | (2006.01) |

(52) U.S. Cl.

CPC ..... *D06F 5/04* (2013.01); *D06F 57/00* (2013.01); *D06F 1/12* (2013.01)

(58) Field of Classification Search

None

See application file for complete search history.

(56) References Cited

U.S. PATENT DOCUMENTS

| | | | | |
|---|---|---|---|---|
| 34,292 A | | 2/1862 | Davis | |
| 262,830 A | | 8/1882 | Rarey | |
| 448,654 A | | 3/1891 | Jantz | |
| 490,372 A | | 1/1893 | Spangler | |
| 523,601 A | | 7/1894 | Sheehy | |
| 823,323 A | | 6/1906 | Dungan | |
| 1,085,397 A | | 1/1914 | Baldwin | |
| 1,185,517 A | | 5/1916 | Magee | |
| 1,215,405 A | | 2/1917 | Perry | |
| 1,413,825 A | | 4/1922 | Benedict | |
| 1,655,250 A | * | 1/1928 | Smith | D06F 1/12 68/197 |
| 2,050,431 A | | 8/1936 | Gubler | |
| 2,320,230 A | | 5/1943 | Glisson | |

(Continued)

FOREIGN PATENT DOCUMENTS

| | | |
|---|---|---|
| JP | H0636543 U | 5/1994 |
| JP | H1024184 A | 1/1998 |

*Primary Examiner* — Michael Barr
*Assistant Examiner* — Cristi Tate-Sims
(74) *Attorney, Agent, or Firm* — Barlow, Josephs & Holmes, Ltd.

(57) ABSTRACT

A washing apparatus includes a housing and a plunge basket. The housing has a sidewall, a closed lower end and an open upper end, defining an internal cavity connected to the open upper end. The housing further has a surface defining a mating forming on the sidewall. The plunge basket is received through the open upper end and within the cavity, and includes a sidewall, a lower perforated surface and an open upper end, defining a compartment to receive clothing therein, a perforated lid removably connected to the open upper end, and a handle having a gripping portion and a rod extending therefrom, connected to the sidewall, and a reciprocal mating formation configured and arranged to cooperate with the mating formation on the housing to guide the plunge basket within the internal cavity of the housing.

4 Claims, 13 Drawing Sheets

(56) References Cited

U.S. PATENT DOCUMENTS

| | | | | |
|---|---|---|---|---|
| 2,341,729 | A * | 2/1944 | Lundgren-Jonson | D06F 5/02 68/156 |
| 2,741,253 | A | 4/1956 | Bernier | |
| 3,512,539 | A | 5/1970 | Hamilton | |
| 6,065,628 | A * | 5/2000 | Page | B21D 28/06 215/324 |
| 6,341,508 | B1 | 1/2002 | Minassian | |
| 7,162,897 | B2 | 1/2007 | Ball | |
| 2002/0170323 | A1* | 11/2002 | Stahl | D06F 15/00 68/122 |
| 2002/0175173 | A1 | 11/2002 | Diesterbeck | |
| 2004/0262322 | A1* | 12/2004 | Middleton | B29C 45/14336 220/675 |
| 2005/0005655 | A1* | 1/2005 | Taylor | D06F 5/02 68/215 |
| 2008/0169281 | A1* | 7/2008 | Borovicka | A47J 37/1295 219/441 |
| 2010/0089926 | A1* | 4/2010 | Lacy | B65F 1/062 220/521 |

* cited by examiner

MANUALLY-OPERATED CLOTHES WASHING APPARATUS

CROSS REFERENCE TO RELATED APPLICATION

This patent document claims priority to earlier filed U.S. Provisional Patent Application No. 62/000,734, filed on May 20, 2014, the entire contents of which are incorporated herein by reference.

BACKGROUND OF THE INVENTION

The invention relates generally to washing and drying clothes. More specifically, the present invention relates to a manually-operated system for washing clothes at home for those who do not have a full washer appliance in their home. More specifically, the present invention relates to washing small loads of laundry in the home thereby obviating the need for taking clothes to a laundry facility, such as a Laundromat.

There is a need for a solution for washing small loads of laundry in between trips to a laundry facility for those who do not have full washer appliance. There are 320 million people in the United States living in 120 million households. Approximately 65% own their own homes and approximately 35% rent. Thus, there are approximately 42 million people who rent and 35,000 coin operated laundries in the United States with 90 million people depending on them.

It is well know that going to a laundry facility, such as a Laundromat, is inconvenient, frustrating and expensive. As a result, there is a demand for a simple, inexpensive device, such as a manually-operated device and system that can clean a small load of laundry in between trips to a laundry facility.

SUMMARY OF THE INVENTION

The present invention preserves the advantages of prior art clothes washing systems. In addition, it provides new advantages not found in currently available systems and overcomes many disadvantages of such currently available systems.

The invention is generally directed to the novel and unique manually-operated clothes washing system. A manually-operated washing apparatus is provided in accordance with the system of the present invention.

It is therefore an object of the present invention to provide a manually-operated clothes washing system that is suitable for washing small loads of laundry.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
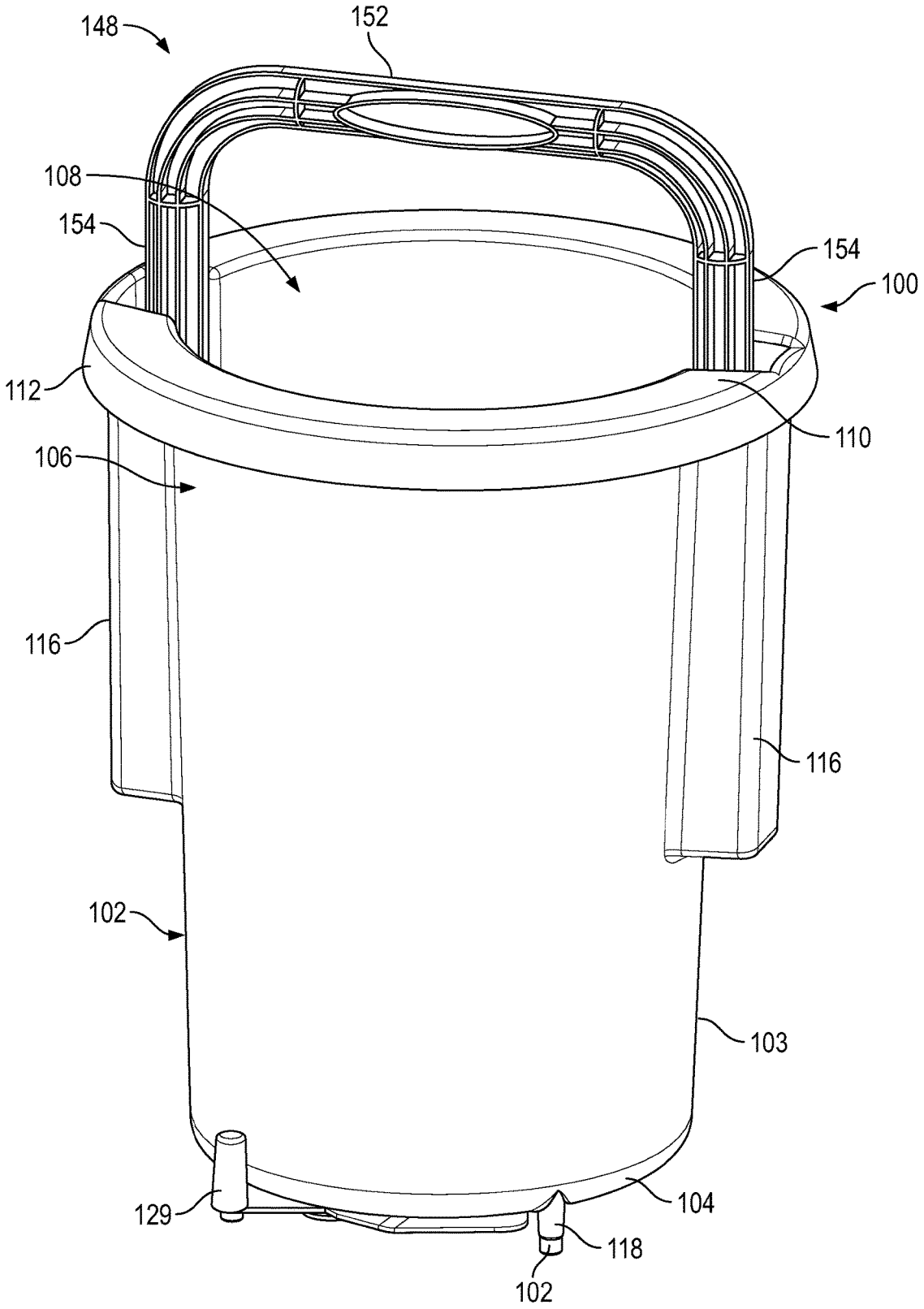
FIG. 1 is a top, front perspective view of the clothes washing apparatus of the present invention in an assembled relation.

Referring to FIGS. 1-13, the manual clothes washing apparatus of the present invention is shown generally at 100. As will be more fully described below, the clothes washing apparatus 100 includes a housing 102 and plunge basket 126. The housing 102 has a sidewall 103, a closed lower end 104 and an open upper end 106, defining an internal cavity 108 connected to the open upper end 106. The housing 102 further has a surface defining a mating forming, such as a plunge channel 116, on the sidewall 103. The plunge basket 126 is received through the open upper end 106 and within the cavity 108, and includes a sidewall 1128, a lower perforated surface 130 and an open upper end 132, defining a compartment 134 to receive clothing 162 therein, a perforated lid 136 removably connected to the open upper end 132, and a handle 148 having a gripping portion 152 and a rod 154 extending therefrom, connected to the sidewall 128, and a reciprocal mating formation, such as a channel guide 146, for example, configured and arranged to cooperate with the meting formation on the housing 102 to guide the plunge basket 126 within the internal cavity 108 of the housing 102.

Figure 2:
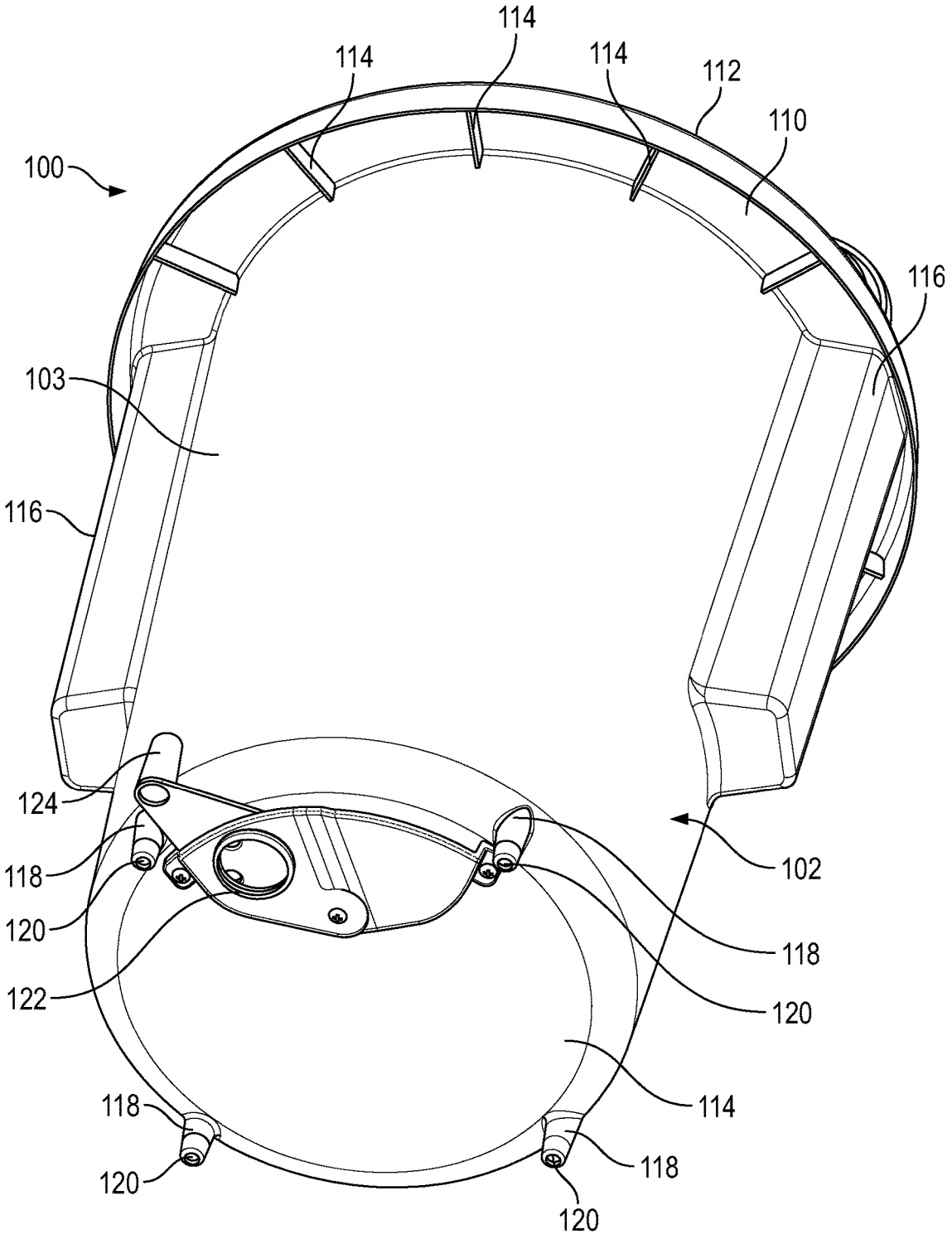
FIG. 2 is a bottom, front perspective view of the clothes washing apparatus of the present invention in an assembled relation with a drain valve closed.

Referring now to FIGS. 1 and 2, the housing 102 includes a sidewall, a closed lower end 104 and an open upper end 106 defining an internal cavity 108 connected to the open upper end 106. Although the housing 102 as shown generally has a cylindrical shape, any tubular configuration may be used. The open upper end 106 includes a rim 110 with a depending skirt 112. The skirt 110 and rim 112 may be reinforced with a number of ribs 114, best seen in FIGS. 2 and 3, connected to the housing 102 to strengthen and provide rigidity to the rim 110 and skirt 112 and open upper end 106, generally. The sidewall 103 includes a mating formation such as a pair of elongate, plunge channels 116, depending through the rim 110 and forming a pair of keyways in the internal cavity 108 of housing 102. The plunge channels 116 may be opposed from one another. The plunge channels 116 may extend about midway a length of the housing 102.

A number of bottom projections 118 may extend from the closed bottom end 104 to stabilize and support the housing 102. The bottom projections 118 may include rubberized or otherwise no-slip pads 120 to prevent the housing 102 from sliding or slipping on a surface.

Figure 3:
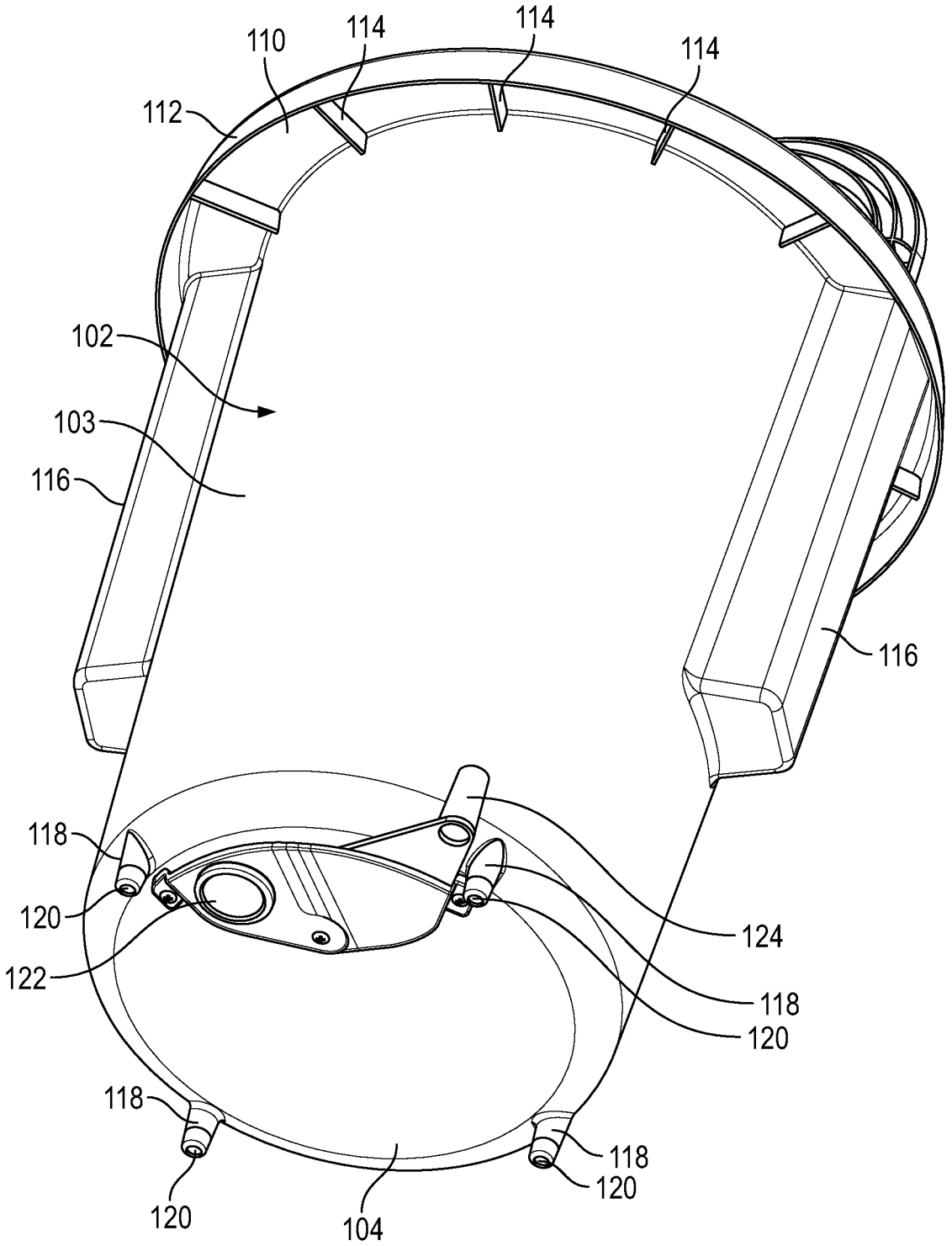
FIG. 3 is a bottom, front perspective view of the clothes washing apparatus of the present invention in an assembled relation with a drain valve open.

A drain 122 may be located near or on the closed bottom end 104 of the housing 102, as desired, and connected to the cavity 108. A drain valve 124 for selectively sealing the drain 122 is connected to the drain 122. The drain valve 124 may be closed, as shown in FIG. 2, or open, as shown in FIG. 3.

Figure 4:
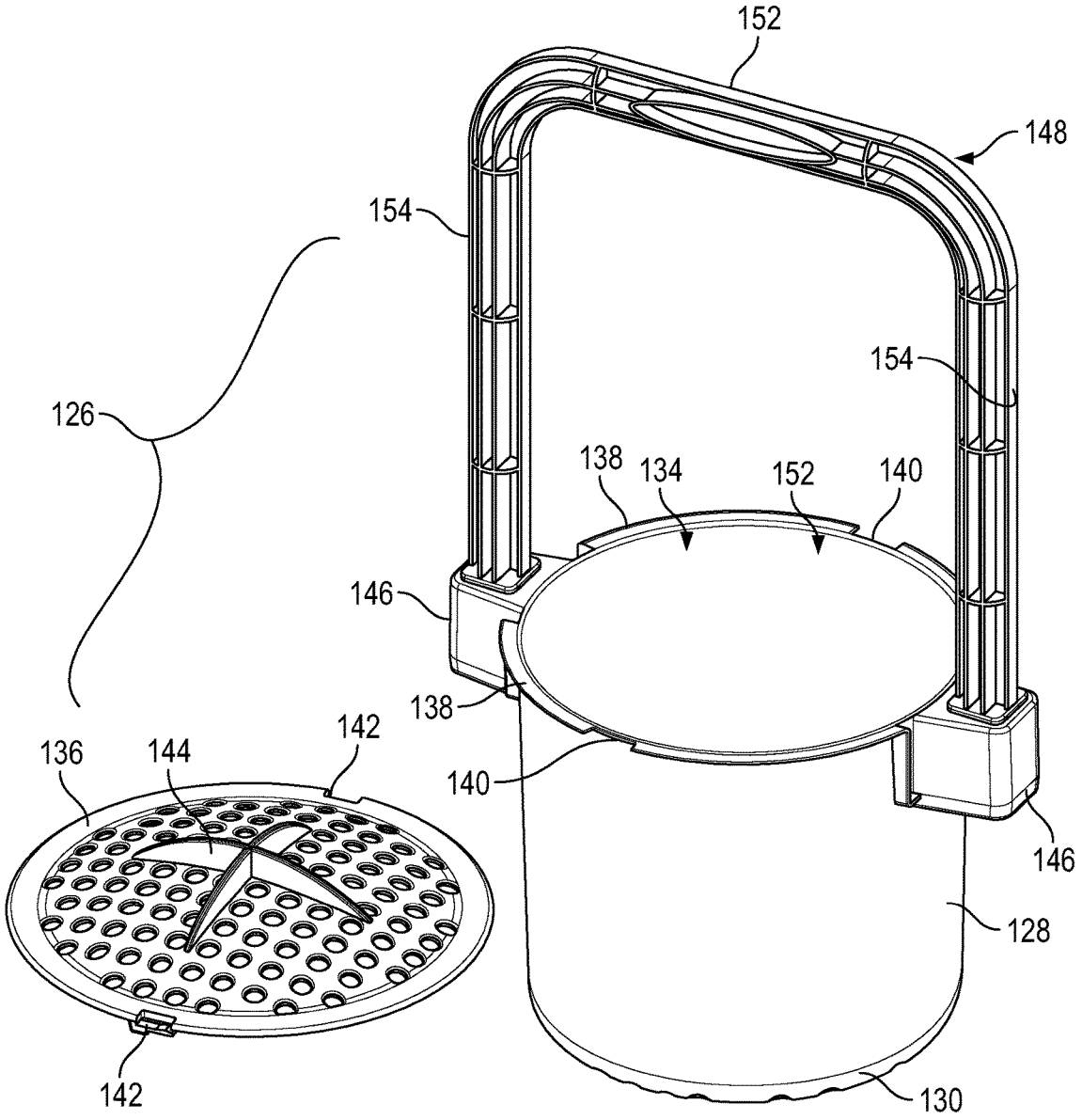
FIG. 4 is a top, perspective view of the plunge basket of the clothes washing apparatus with the perforated lid removed.
Figure 5:
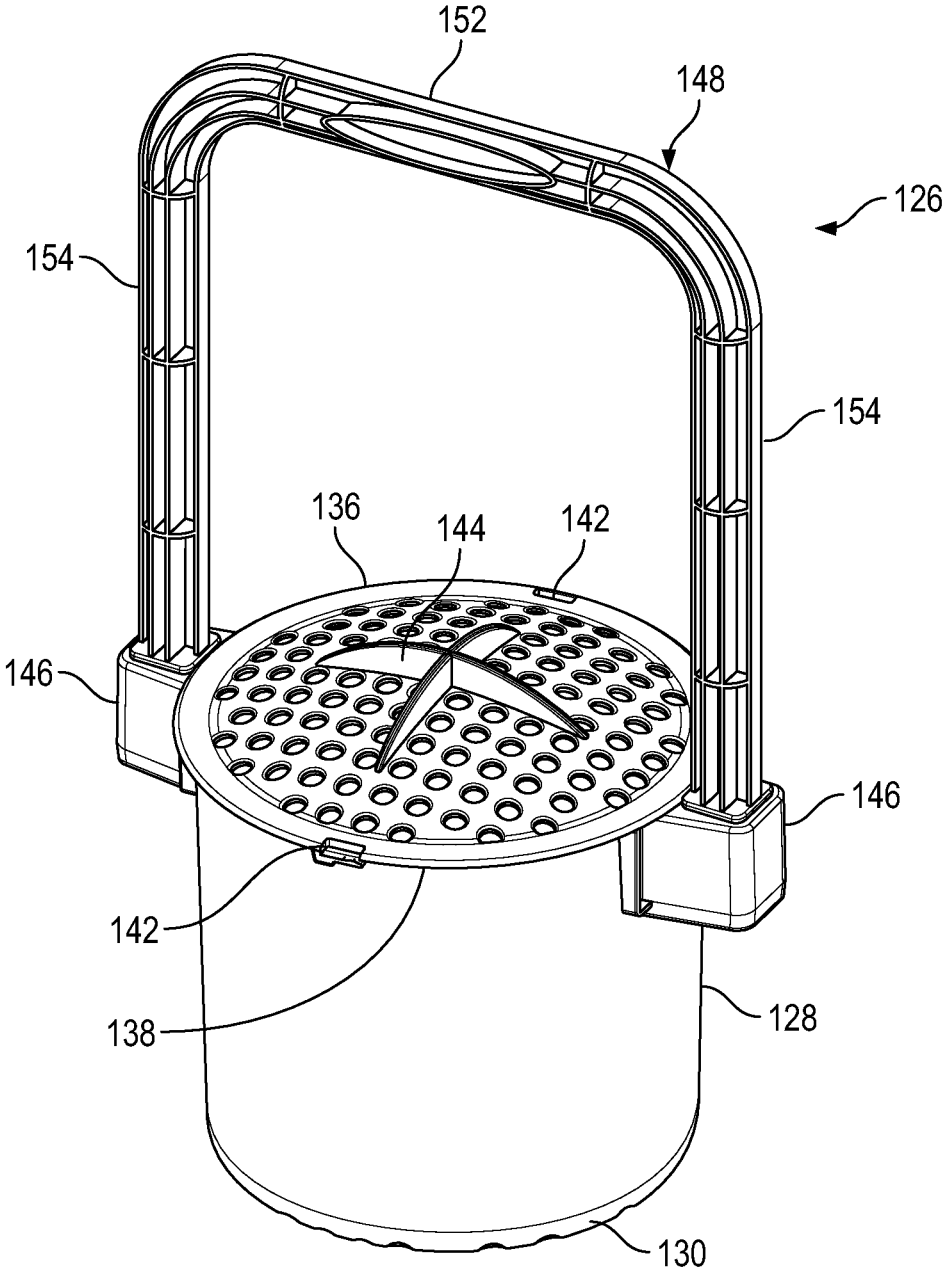
FIG. 5 is a top, front perspective view of the plunge basket of the clothes washing apparatus, in an assembled relation.
Figure 6:
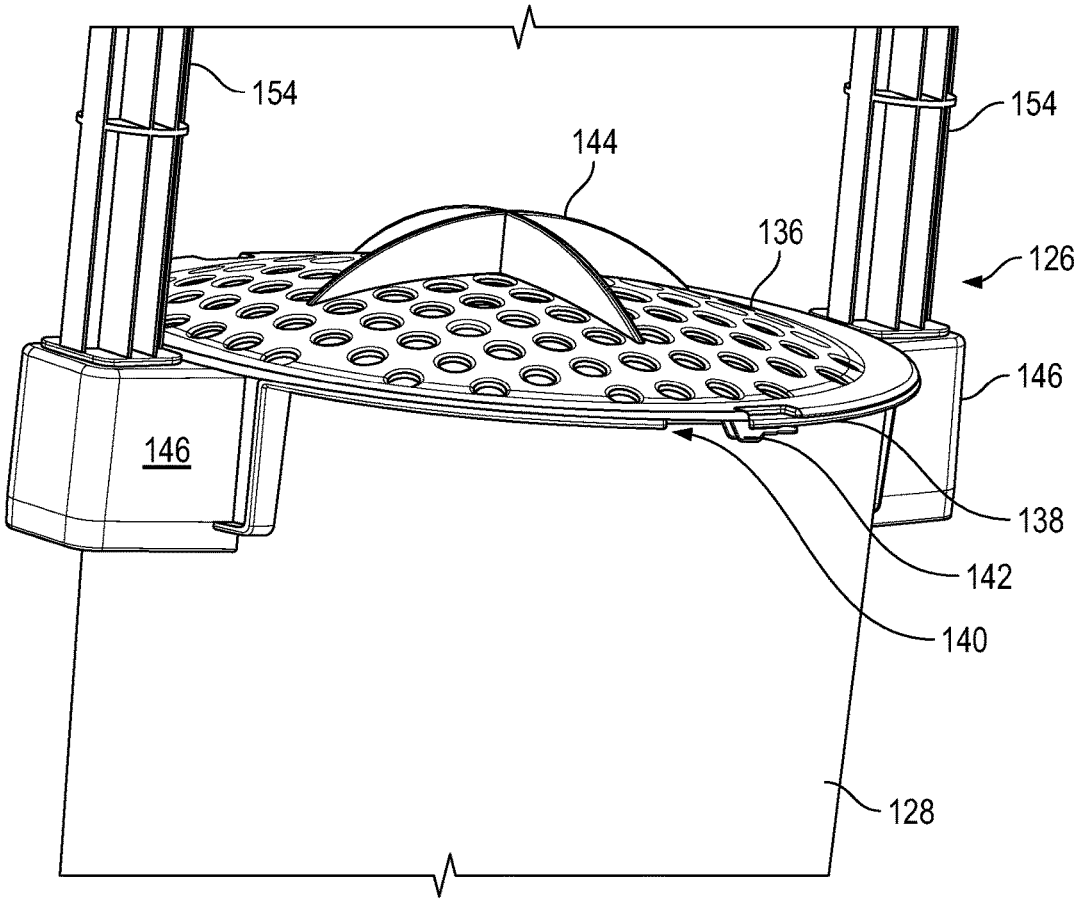
FIG. 6 is a partial, top, front perspective view of the plunge basket illustrating the latching mechanism of the perforated lid to the plunge basket.

Referring to FIGS. 4-6, the plunge basket 126 includes a sidewall 128, a lower perforated surface 130 and an open upper end 132, defining a compartment 134 to receive clothing 162 therein. The plunge basket 126 is sized and dimensioned to be received within the cavity 108 of the housing 102. A removable perforated lid 136 is configured to secure to the open upper end 132 of the plunge basket 126. The open upper end 132 includes an annular lip 138 extending partially around the open upper end 132. The annular lip 138 includes a surface forming a recess 140 in the annular lip 138. The perforated lid 136 includes resilient members 142 depending from a bottom surface of the perforated lid 136, configured and arranged to cooperate with the recess 140 in annular lip 136, best seen in FIG. 6, to removably secure the perforated lid 136 thereto. Although there are a pair of recesses 136 and resilient members 142 shown in the exemplary embodiment, the number may be selected as desired. The perforated lid 136 further includes a number of fins 144 extending therefrom, providing a gripping surface for a user to lock and unlock the perforated lid 136 to the open upper end 132 of the plunge basket 126.

Figure 7:
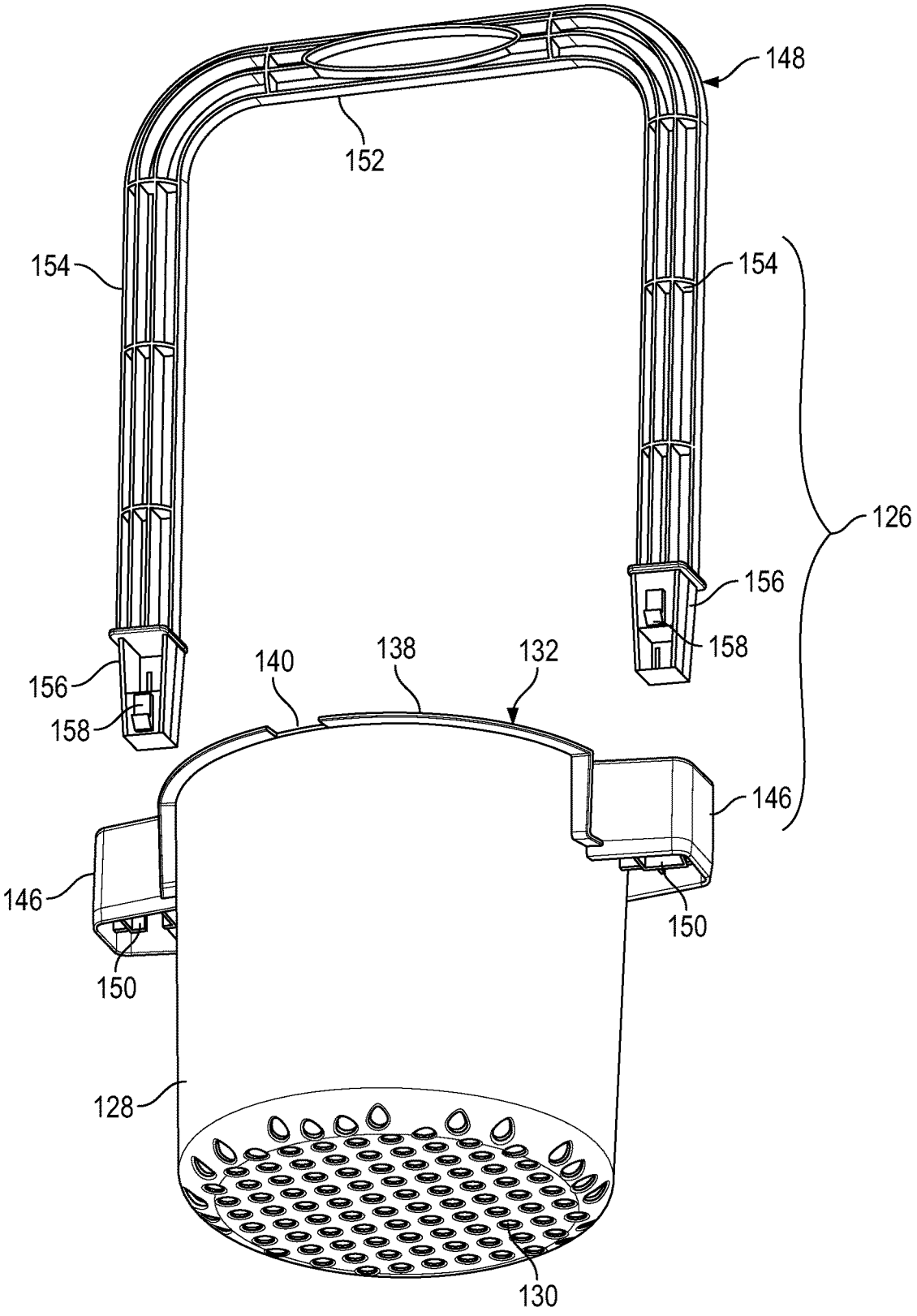
FIG. 7 is a partially exploded view of the plunge basket of the clothes washing apparatus, illustrating the handle separated from the plunge basket.
Figure 8:
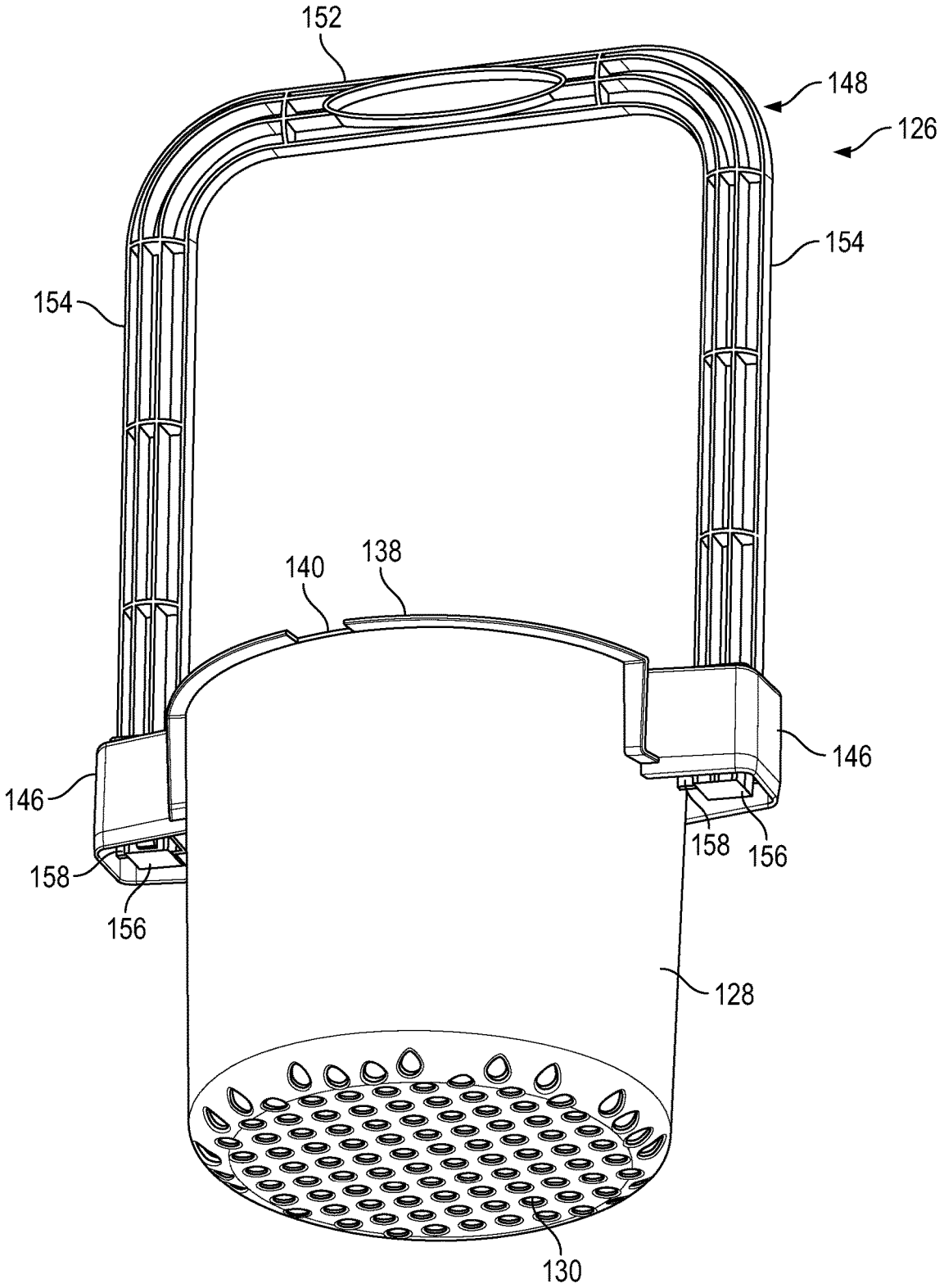
FIG. 8 is a bottom, front perspective view of the plunge basket of the clothes washing apparatus.
Figure 9:
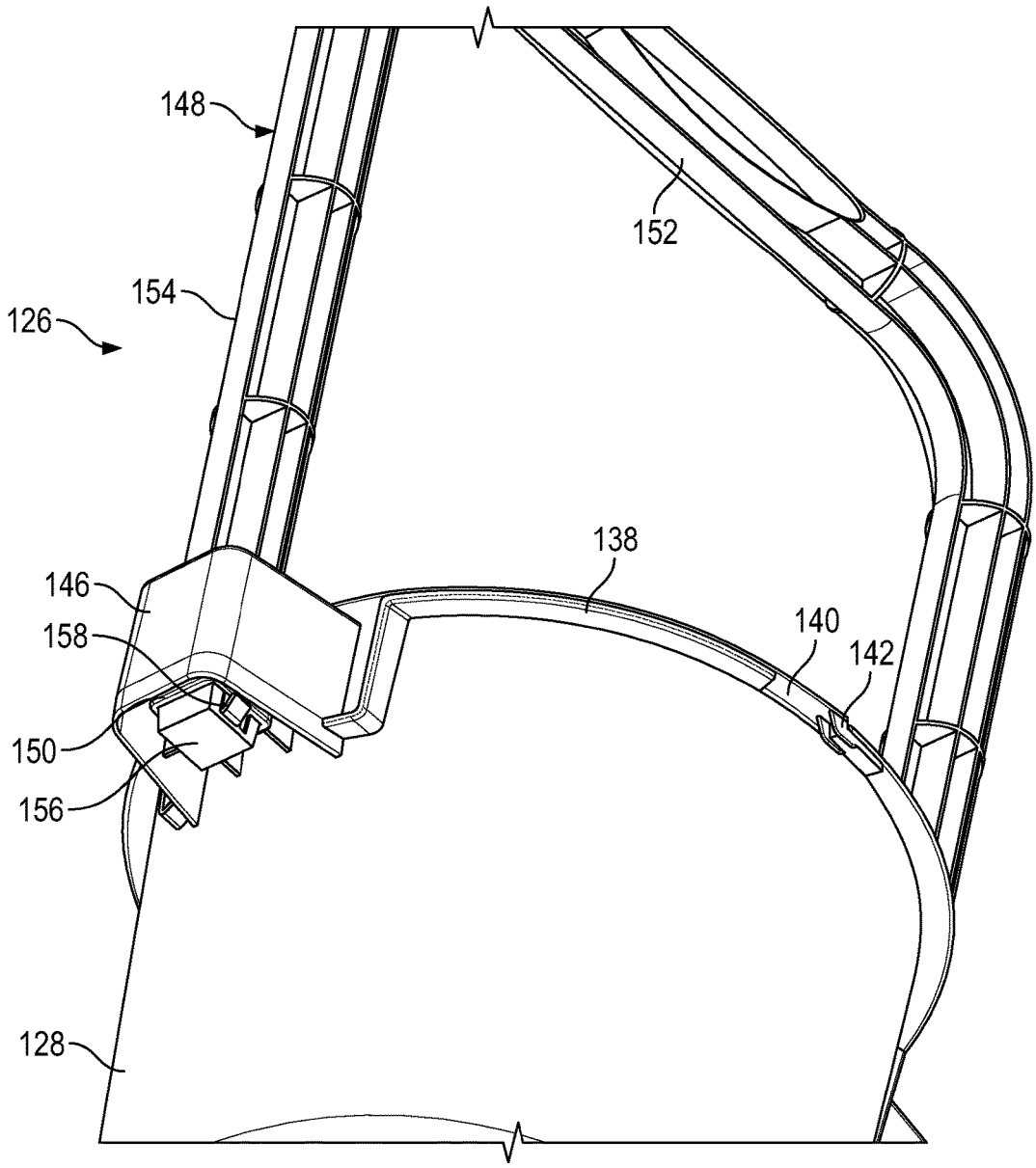
FIG. 9 is a partial front, bottom, side, perspective view of the plunge basket illustrating the attachment of a handle to the plunge basket.

On the sidewall 128 of the plunge basket 126 are reciprocal mating formations configured to engage the mating formations on the housing 102, such as channel guides 146 extending outwardly from the sidewall 126. In this exemplary embodiment, the channel guides 146 are sized and dimensioned to freely slide within the plunge channels 116 of the housing 102. In this exemplary embodiment, the channel guides 146 also serve as a mounting point for a handle 148, as shown in FIGS. 7-9. More specifically, each channel guide 146 includes a surface defining an aperture 150 therethrough. The handle 148 includes a gripping portion 152 for a user to hold and two elongate rods 154 depending from opposing ends of the gripping portion 152. Each rod 154 includes a distal end 156 with a pair of resilient locking members 158 thereon, best seen in FIG. 7. The distal ends 156 are inserted into the apertures 150 on the channel guides 146, deflecting the resilient locking members 158 until the resilient locking members 158 snap into a locking position when the distal ends 156 of rods 154 are fully seated in each aperture 150 of the channel guides 146, best seen in FIG. 9.

It is important to note that the exemplary mating formation and reciprocal mating formation discussed in this embodiment of the washing apparatus 100, namely the plunge channels 116 and channel guides 146, may be inverted, reversed, or swapped. Regardless of form, the essential feature of the mating formation and reciprocal mating formation is that the two structure cooperate together to guide the plunge basket 126 within the housing 102 of the washing apparatus 100.

Figure 10:
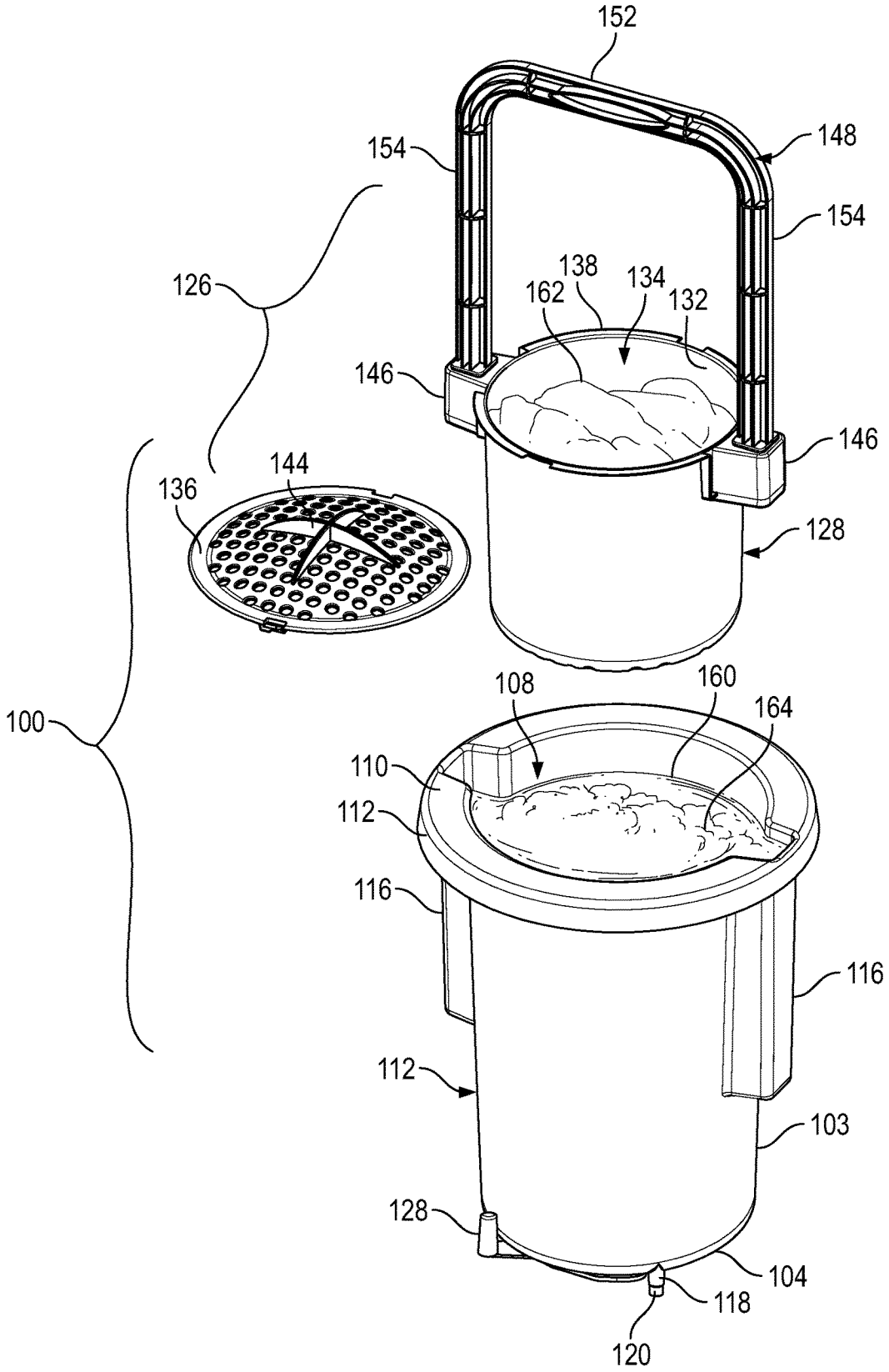
FIG. 10 is a partially exploded view of the clothes washing apparatus of the present invention, illustrating a lid removed from a plunge basket and the plunge basket separated from the housing.
Figure 11:
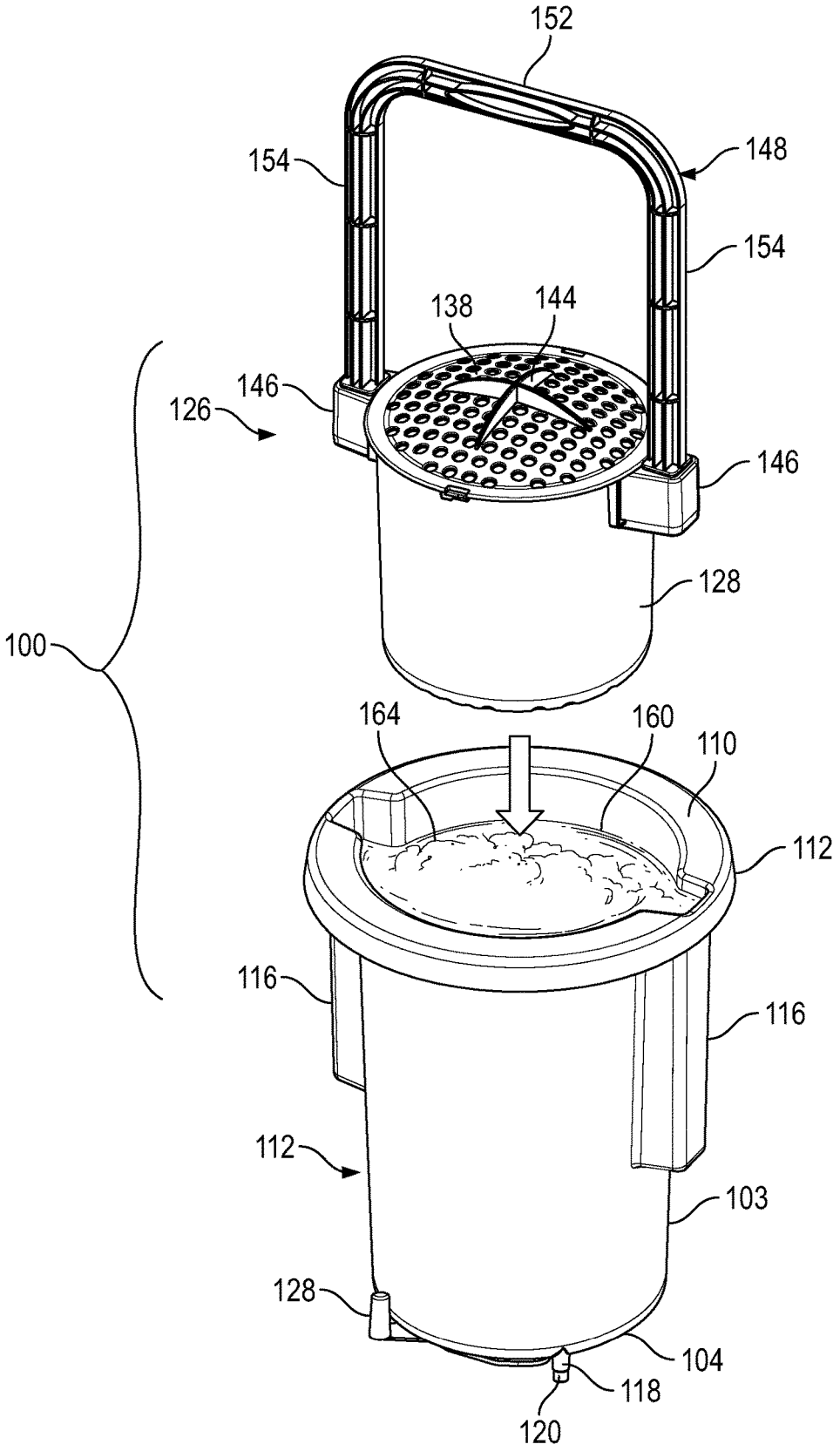
FIG. 11 is a partially exploded view of the clothes washing apparatus of the present invention, illustrating the plunge basket separated from the housing.
Figure 12:
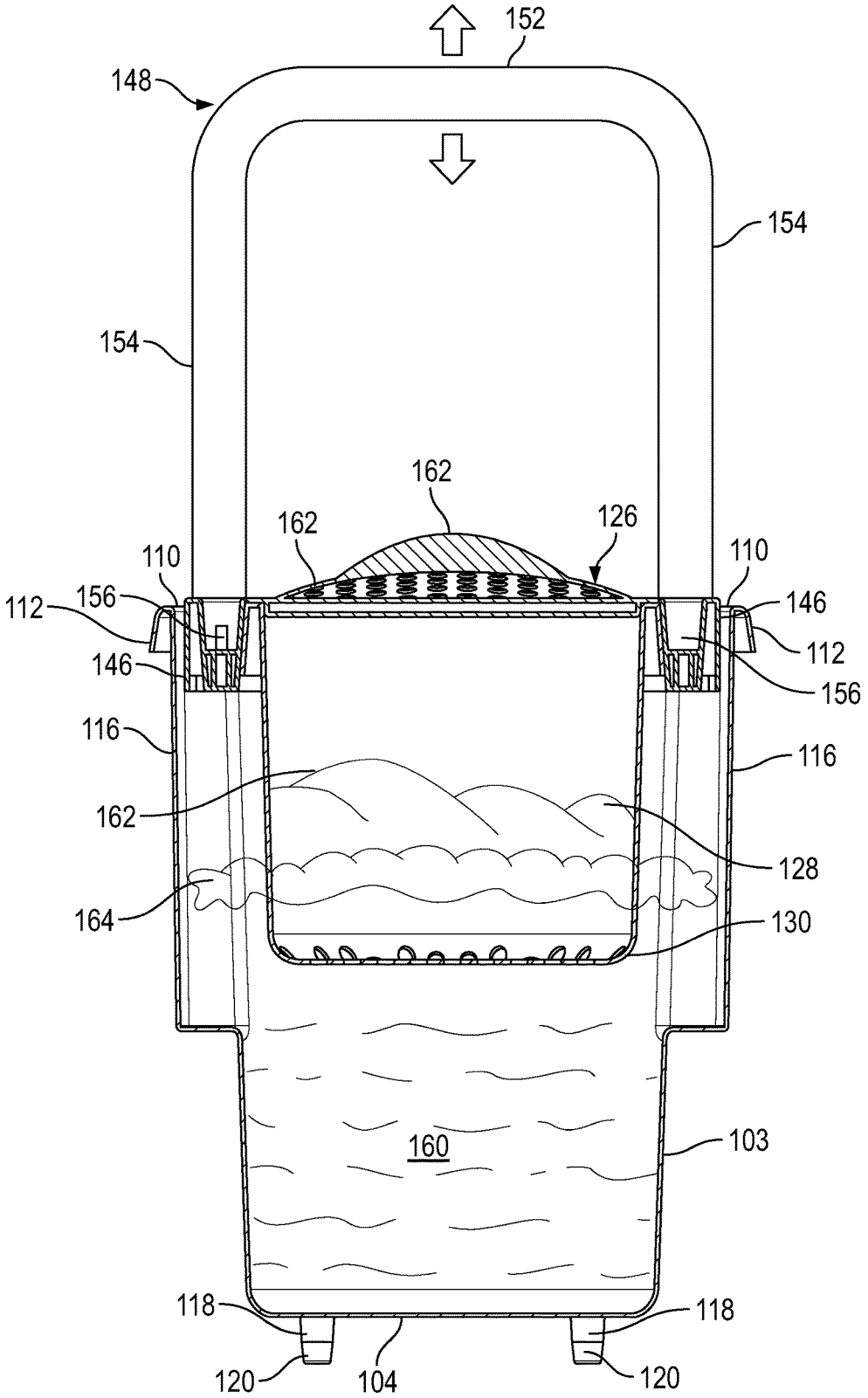
FIG. 12 is a cross-section view of the clothes washing apparatus of the present invention in an assembled relation, with the plunge basket partially inserted into the housing.
Figure 13:
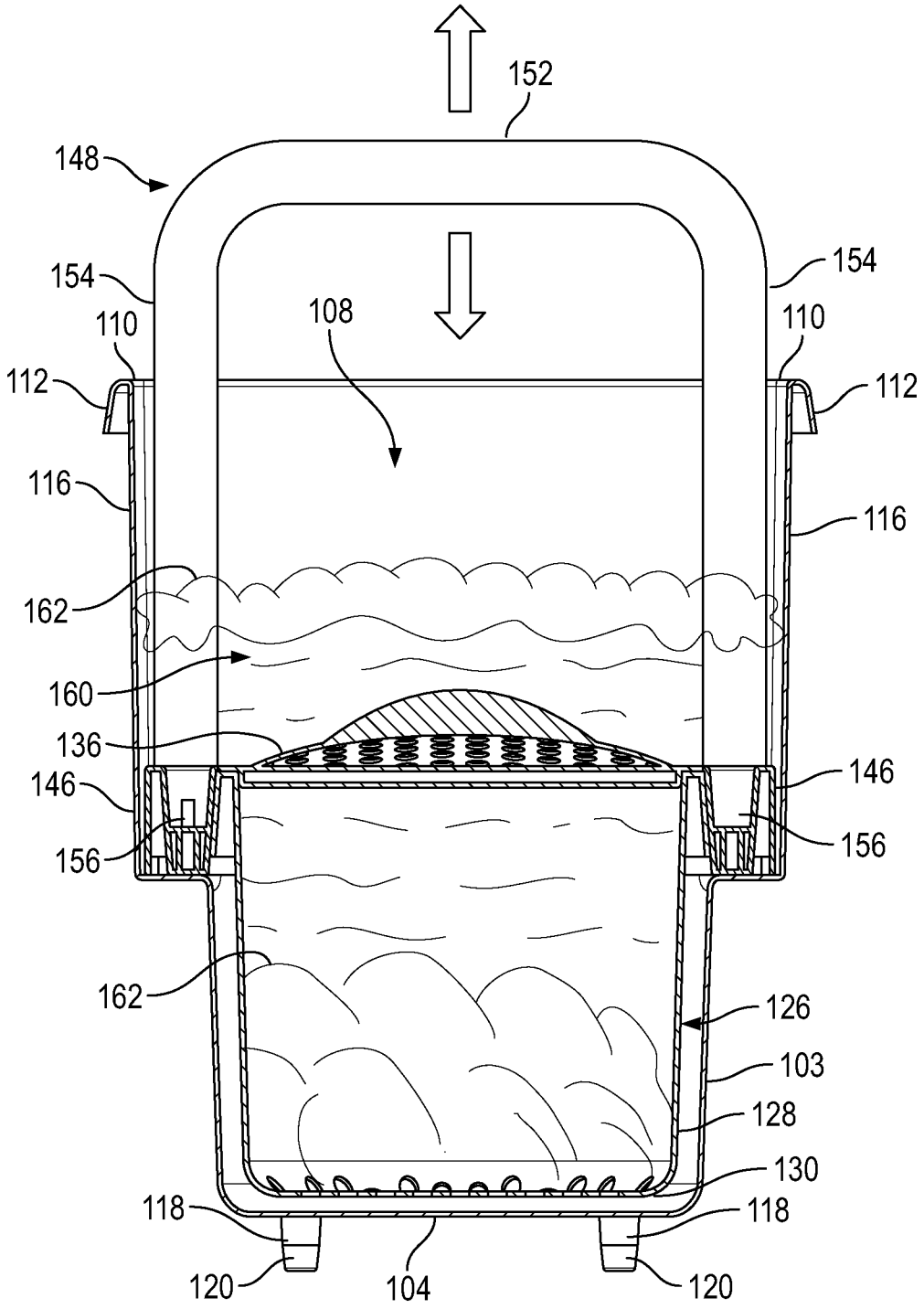
FIG. 13 is a cross-section view of the clothes washing apparatus of the present invention in an assembled relation, with the plunge basket fully inserted into the housing.

In use, as shown in FIGS. 10-13, the housing 102 is filled with water 160 at a desired temperature to a desired height within the housing 102 with the drain valve 124 closed. The appropriate amount of detergent 164 and any other additives is added, as desired. Clothes 162 are placed inside the clothing plunge basket 126, as best seen in FIG. 10, and the perforated lid 136 secured thereto, best seen in FIG. 11. The plunge basket 126 and clothes therein are immersed in the water of the housing 102 and the plunge basket 126 is pulled and pushed up and down thereby agitating the clothing and detergent as illustrated in FIGS. 12 and 13. The clothing is cleaned by the significant water pressure and flow, which is generated inside the housing 102. Superior washing results are achieved with the washing apparatus 100.

After washing is complete, the clothes are preferably wrung out. For example, a roller or lever mechanism (not shown) can be incorporated into the basket 126 to compress the clothes to remove excess water. Such a construction can be similar, for example, to a commercial style mop bucket. Wringing can be carried out over a sink or over or in the housing before or after the dirty water therein in emptied therefrom.

When washing and wringing is complete, the drain valve 124, as best seen in FIGS. 2 and 3, is opened and the dirty water is permitted to exit through the drain 122 in a bathtub or shower stall, for example. Further manual cycles, such as for rinsing, may be carried out, if desired.

The washing apparatus 100 can be made out of any suitable material. For example, plastic is preferably used but any other materials, such as metals, can be used.

It would be appreciated by those skilled in the art that various changes and modifications can be made to the illustrated embodiments without departing from the spirit of the present invention. All such modifications and changes are intended to be covered by the appended claims.

What is claimed is:

1. A washing apparatus, comprising:

a housing having a sidewall with an inner wall surface, an outer surface, closed lower end and an open upper end; the housing defining an internal cavity in communication with the open upper end; the inner cavity configured to receive clothes washing water therein; the inner wall surface of the housing further defining a first elongated U-shaped vertical guide channel and a second vertical guide channel each having a vertical channel outer wall having a top channel edge and a bottom channel edge, two vertical channel side walls each having a top channel edge and a bottom channel edge; a closed channel bottom wall disposed at the bottom edges of the vertical channel outer wall and the two vertical channel walls; the top edges of the vertical channel outer wall and the two vertical channel side walls defining an upper channel opening at the open upper end of the housing; the vertical guide channels being disposed on opposed sides of the housing from each other;

a plunge basket received through the open upper end of the housing and within the internal cavity, the plunge basket having a compartment container with an outer surface and a perforated floor and an open top end with a perforated lid releasably secured to the open top end of the compartment container and configured to receive clothes to be washed with the clothes washing water therein; a first channel guide member and a second channel guide member, each having a top and bottom side, emanating outwardly from the outer surface of the plunge basket and being of a shape that is substantially U-shaped and complementary to the U-shaped vertical channel outer wall; the first channel guide member and the second channel guide members being freely insertable and removable from their respective first vertical guide channel and second vertical guide channel and via their respective upper channel openings to permit complete separation of the plunge basket from the housing;

a handle having a first rigid member with a first end and a second end and a second rigid member with a first end and a second end; the first end of the first rigid member being rigidly secured to the top side of the first channel guide member and the first end of the second rigid member being rigidly secured to the top side of the second channel guide member; a cross member rigidly secured to the second end of the first rigid member and the second end of the second rigid member; the handle being rigidly and fixedly connected to the plunge basket;

whereby vertical actuation of the handle up and down by a user vertically actuates the plunge basket up and down in a vertically keyed fashion within the cavity with the first guide member and the second guide member vertically actuating up and down within the respective first vertical guide channel and second vertical guide channel to force wash water through the perforated floor and perforated lid of the plunge basket to wash clothing residing in the compartment of the plunge basket.

2. The washing apparatus of claim 1, wherein the open upper end includes a rim with a depending skirt.

3. The washing apparatus of claim 2, further comprising a number of ribs connected to the rim, skirt and housing, providing strength and rigidity thereto.

4. The washing apparatus of claim 1, further comprising:

a number of fins extending form the perforated lid providing a gripping surface for a user to releasably secure the perforated lid to and remove the perforated lid from the open top end of the compartment container.

* * * * *